United States Patent [19]

Rosenberg

[11] Patent Number: 4,711,261

[45] Date of Patent: Dec. 8, 1987

[54] CUSHIONING CRUTCH SUPPORT COVERING

[76] Inventor: Carol S. Rosenberg, 14 Red Rock Trail, Saddle River, N.J. 07458

[21] Appl. No.: 798,984

[22] Filed: Nov. 18, 1985

Related U.S. Application Data

[63] Continuation-in-part of Ser. No. 628,256, Jul. 6, 1984, abandoned.

[51] Int. Cl.[4] ..... A61H 3/02

[52] U.S. Cl. ..... 135/72; 135/71; 128/DIG. 15

[58] Field of Search ..... 135/66, 65, 68, 71, 135/72, 73, 82, 86; 5/497; 128/DIG. 15

[56] References Cited

U.S. PATENT DOCUMENTS

| | | | |
|---|---|---|---|
| 1,278,664 | 9/1918 | Hunter | 135/73 |
| 1,401,305 | 12/1921 | Beecroft | 135/73 |
| 1,499,458 | 5/1923 | Hughes | 135/69 |
| 1,509,778 | 10/1920 | Raymond | 135/68 |
| 1,673,609 | 6/1928 | Weis | 135/73 |
| 1,732,763 | 10/1929 | McKeag | 135/73 |
| 1,906,264 | 5/1933 | Higgins | 135/73 |
| 2,174,588 | 10/1939 | Manzeck | 135/72 |
| 3,000,384 | 9/1961 | Piers, Jr. | 128/DIG. 15 X |
| 3,111,688 | 11/1963 | Barnes | 5/497 |
| 3,194,234 | 7/1965 | Duckman et al. | 128/DIG. 15 |
| 3,273,175 | 9/1966 | Anderson et al. | 5/497 |
| 3,438,068 | 4/1969 | Anderson et al. | 5/497 |
| 3,538,914 | 11/1970 | Myers | 128/DIG. 15 |
| 3,710,790 | 1/1973 | Lemon | 128/DIG. 15 X |
| 4,027,687 | 6/1977 | McGowan | 135/68 X |
| 4,384,380 | 5/1983 | Glaha et al. | 5/497 |

FOREIGN PATENT DOCUMENTS

| | | | |
|---|---|---|---|
| 116761 | 6/1918 | United Kingdom | 135/73 |

*Primary Examiner*—Robert A. Hafer
*Assistant Examiner*—D. Neal Muir

[57] ABSTRACT

A cushioning covering for a load bearing member of a medical crutch having a pair of transversely spaced columns, the load bearing member consisting of an underarm support fixed generally between the upper ends of the columns and a cushion disposed upon the underarm support, consists of an enclosed-volume-defining element formed of a cushioning fabric that is washable, soft to the touch and perspiration absorbent. The element has an opening for passage of the underarm support and cushion through the opening into the volume of the element, and elements disposed adjacent the opening for releasably securing the cushioning covering tightly about the entire surface of the load bearing member. A cushioning covering for engaging about the crutch hand grip support is also described.

6 Claims, 4 Drawing Figures

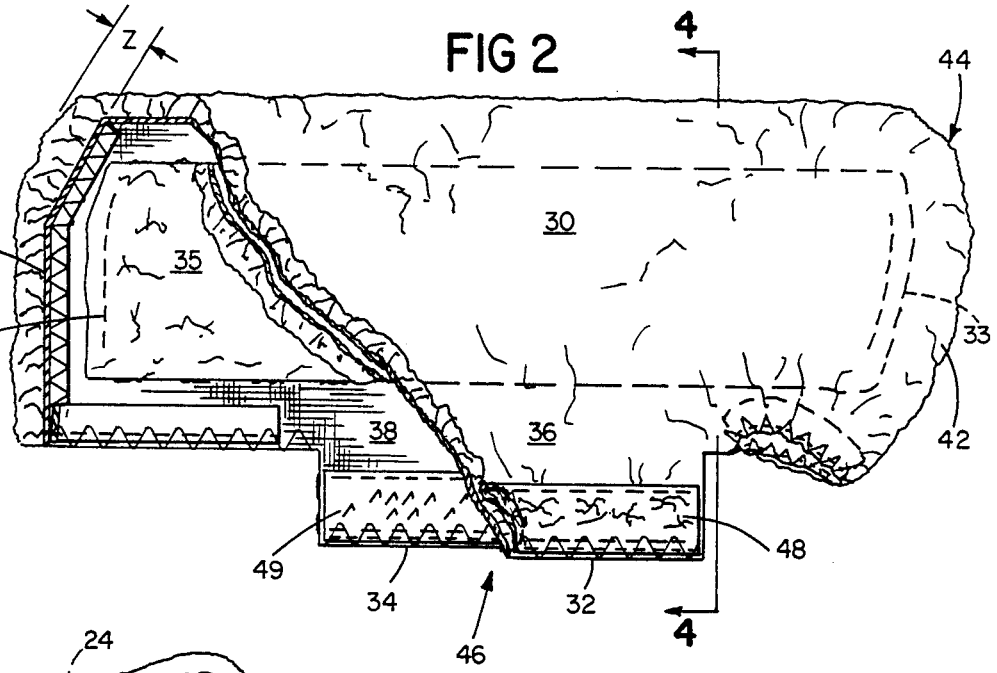
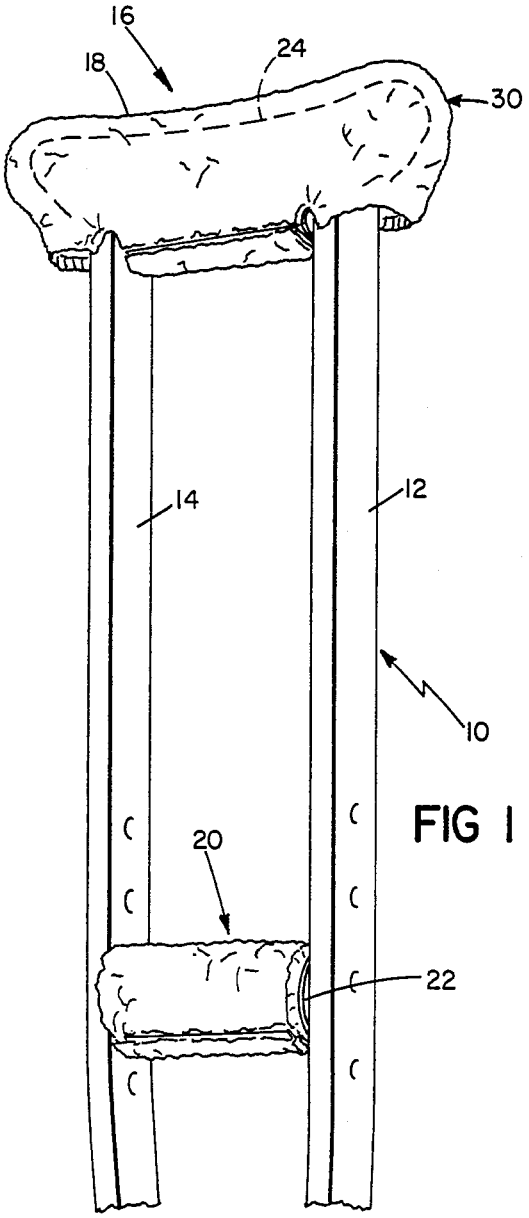
FIG 1
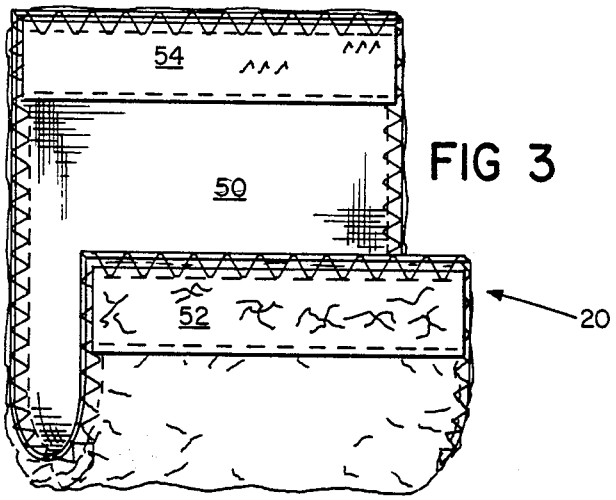
FIG 3
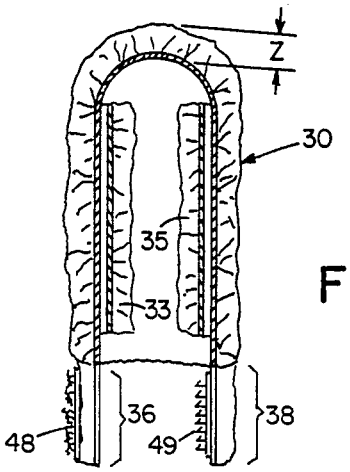
FIG 4

CUSHIONING CRUTCH SUPPORT COVERING

BACKGROUND OF THE INVENTION

This is a continuation-in-part application of U.S. application No. 628,256, filed July 6, 1984, now abandoned.

The invention relates to medical accessories, and in particular to a device for use with crutches.

Medical crutches are usually provided with pads or cushions, typically of rubber, foam or the like, at the points where the patient leans for support, i.e., on the top underarm supports, upon which the temporary user sometimes incorrectly rests most heavily, on sometimes on the handgrips as well. One common problem during proper use of the crutches, i.e., where the patient's body weight is supported primarily through the hand grips, is that the patient often develops callouses. Also, friction and excessive clothing wear can result from the rubbing movement of the tops of the crutches against the sides of the body adjacent the user's underarms, especially when the patient improperly leans heavily on the top support. The pads generally have smooth surfaces that become slippery when the patient perspires, as is a common result of the unusual exertion required to move on crutches, and the pads have the tendency to become soiled, particularly when the surfaces become abraded after long use, and they are not easily cleaned. This soil is transferred to clothing or to the user's hands.

SUMMARY OF THE INVENTION

According to one aspect, the invention consists of a cushioning covering for a load-bearing member of a medical crutch, the crutch having a pair of transversely spaced columns, and the load bearing member comprising an underarm support fixed generally between the upper ends of the columns and a cushion disposed upon the underarm support, the cushioning covering of the invention comprising an enclosed-volume-defining element formed of a cushioning fabric that is washable, soft to the touch and perspiration absorbent, the element having an opening sized and adapted for passage of the underarm support and cushion through the opening into the volume of the element, and means disposed adjacent the opening for releasably securing the cushioning covering tightly about the entire surface of the load-bearing member, the securing means comprising means for gathering first and second opposed, spaced segments of the peripheral portion of the element defining the opening generally beneath the underarm support, about the exposed, outer edges of the crutch columns, and, means for releasable interengagement of third and fourth opposed, spaced segments of the peripheral portion of the element defining the opening, the third and fourth segments adapted for interengagement generally beneath the underarm support, between the opposed inner edges of the crutch columns.

According to another aspect, the invention consists of a cushioning covering assembly of load bearing members of a medical crutch, the crutch having a pair of transversely spaced columns, a first load bearing member comprising an underarm support fixed generally between the upper ends of the columns, a second load bearing member comprising a generally cylindrical handle spaced from the underarm support along the columns and fixed therebetween, and cushions disposed upon the underarm support and the handle, the cushioning covering assembly of the invention comprising a first cushioning covering for the first load bearing member consisting of an enclosed-volume-defining element formed of a cushioning fabric that is washable, soft to the touch and perspiration absorbent, the first element having an opening sized and adapted for passage of the underarm support and cushion through the opening into the volume of the element, and means disposed adjacent the opening for releasably securing the first cushioning covering tightly about the entire surface of the first load bearing member, securing means comprising means for gathering first and second opposed, spaced segments of the peripheral portion of the first element defining the opening generally beneath the underarm support, about the exposed, outer edges of the crutch columns, and means for releasable interengagement of third and fourth opposed, spaced segments of the peripheral portion of the first element defining the opening, the third and fourth segments adapted for interengagement generally beneath the underarm support, between the opposed inner edges of the crutch columns, and a second cushioning covering for the second load bearing member, comprising a second element sized and adapted to extend along the handle and cushion between the crutch columns and to extend about the circumference of the handle, and means disposed adjacent opposed edges of the second element for releasable interengagement of the edges to tightly fasten the second cushioning covering about the entire surface of the second load bearing member, the second element being formed of a cushioning fabric that is washable, soft to the touch and perspiration absorbent.

In preferred embodiments of both aspects of the invention, the cushioning covering has nap of at least about ¼ inch and the enclosed-volume-defining element contains additional padding of the same fabric for the comfort of the user.

It is an object of this invention to provide accessories for use with crutches that provide additional padding for the comfort of the user, while alleviating the usual problems of excessive wear of clothing, wear and irritation of the skin, particularly of the hands, slipping and soiling of clothing and hands.

PREFERRED EMBODIMENT

I first briefly describe the drawings:

Drawings

FIG. 1 is a perspective view of the upper portion of a typical medical crutch equipped with the covers of the invention;

FIG. 2 is side view, partially in section, of the cover for the crutch underarm support;

FIG. 3 is an enlarged perspective view of the cover for the crutch handle; and FIG. 4 is a side section view taken at 4—4 of FIG. 2.

Referring to FIG. 1, medical crutch 10 consists of two generally upright supports 12, 14, a crossbar 16 extending between the supports at the top, typically slightly curved 18 to conform to the underarm of the user, and a crossbar handle 20. The use of crutches is usually necessary for only a relatively short period of time, so crutches are sometimes leased or borrowed rather than purchased and a single pair can be used by many different people. The position of the handle 20 along the supports is adjustable to suit the individual. The height of the underarm support is also typically adjustable by means of a central post (not shown) affixed between the lower ends of the upright supports.

The top support and the handle are both equipped with pads or cushions formed, e.g., of rubber, foam or the like, typically with a smooth, hard outer surface. The handle cushion 22 is cylindrical. The underarm cushion 24 is saddle-shaped to distribute the user's weight as much as possible.

Referring now also to FIG. 2, the underarm cushioned support cover 30 is manufactured of a soft, thick, highly absorbent, washable material, e.g. polyester fabric that resembles sheepskin, sold by Furtex Marketing Corp., 457th Avenue, New York, N.Y. 10001 under the trademark "SHERPA", or other similar washable cushioning fabric, of high nap, N, (e.g., between about ¼ and ½ inch thick). A sheet of this material is cut to size. For a medical crutch of standard dimensions, the highly padded fabric is about 10 inches by 7½ inches. Vertical cuts about 1 inch deep and 4 inches apart are made in the top and bottom edges 32, 34 and the sides trimmed to form center flaps 36, 38. The fabric is folded to bring the top and bottom edges together with the side edges 40, 42 aligned. Referring also to FIG. 4, to provide additional padding for the user, two strips 33, 35 of the soft, thick material of the cushioned support cover are affixed, in opposed relationship, to the inner surfaces of the cover 30 by stitching 43 adjacent the side edges of the cover. The side edges of the cover are then trimmed, generally in an arc 44 to conform to the shape of the cushion, and then stitched together to define a volume sized to enclose the underarm support cushion, with the top and bottom edges of the highly padded fabric defining opening 46, about 10 inches wide. Stretched elastic is stitched along the periphery of the opening between the top and bottom flaps at both sides. When the elastic is allowed to relax, the opening is gathered to a width of about 7 inches. Hook-and-loop fasteners 48, 49 of the type which releasably adhere to each other when pressed together, e.g. as sold under the trademark "Velcro", are then attached by stitching to the top and bottom flaps, respectively. To position the covering over the crutch cushion, the elastic at the opening is stretched outward to enlarge the opening to allow passage of the cushioned support into the volume of the covering. Once the cushion is positioned, the elastic is allowed to contract about the upright supports to aid in holding the covering in place. The top flap is then folded into position beneath the support with the hook portion of the fastener exposed, and the bottom flap is folded up to engage the opposed loop portion of the fastener thereupon to further fix the well padded covering in position.

Referring now to FIG. 3, the handle cover 50 consists of a rectangular piece of fabric of the same soft, highly padded material cut to the desired size, e.g., about 4 inches by about 7½ inches. Again the edges of the fabric are stitched, and hook-and-loop fasteners 52, 54 are attached to the opposed ends of the covering. The covering is positioned about the handle cushion, and the opposed hook-and-loop fastener portions are engaged to secure the covering in position.

A semiambulatory patient uses a medical crutch by gripping the handle and positioning the underarm support appropriately. The crutch can then be moved in unison with an injured leg or foot to allow the patient a limited degree of mobility.

The crutch equipped with the highly padded covers of the invention is used according to the normal procedures, however the underarm support and handle surfaces are now well padded with covers formed of a soft, clean and absorbent material. The nature of the covering fabric results in less wear to clothing, and the patient is less likely to develop calluses. The patient's hand and clothing do not become quickly soiled, and perspiration is absorbed by the fabric of the covers and thus does not cause the handle to become slippery. Furthermore, the covers are easily removed by disengaging the opposed portions of the hook-and-loop fasteners, and the coverings are machine washable and can be used again and again.

Other features of the invention are within the following claims.

What is claimed is:

1. A cushioning covering for a load bearing member of a medical crutch, the crutch having a pair of transversely spaced columns, and the load bearing member comprising an underarm support fixed generally between the upper ends of the columns and a cushion disposed upon the underarm support, said cushioning covering comprising:

an enclosed-volume-defining element formed of a cushioning fabric that is washable, soft to the touch and perspiration absorbent, said element having top and side portions sized to tightly engage the top and side portions of said cushion and first and second end portions between said side portions, said end portions having first and second peripheral portions, said element having an opening provided by said side portions and said peripheral portions of said end portions and sized and adapted for passage of the underarm support and cushion through said opening into the volume of said element defined by said top, side, and end portions, and means disposed adjacent said opening for releasably securing said cushioning covering tightly about the entire surface of the load-bearing member, said securing means comprising:

elastic means for gathering said first and second peripheral portions beneath an underarm support, about exposed, outer edges of crutch columns, and first and second elongated flaps extending from said side portions and adapted for overlapping interengagement along the lengths of said elongated overlapping flaps beneath the underarm support, between opposed inner edges of crutch columns, to provide tight secured fitting of said covering entirely around said load bearing member.

2. The cushioning covering of claim 1 wherein said cushioning fabric has nap of at least about ¼ inch.

3. The cushioning cover of claim 1 wherein said enclosed-volume-defining element contains additional padding members for the comfort of the user extending along said side portions.

4. A cushioning covering assembly for load bearing members of a medical crutch, the crutch having a pair of transversely spaced columns, a first load bearing member comprising an underarm support fixed generally between the upper ends of the columns, a second load bearing member comprising a generally cylindrical handle spaced from the underarm support along the columns and fixed therebetween, and cushions disposed upon the underarm support and the handle, said cushioning covering assembly comprising:

a first cushioning covering for the first load bearing member comprising:

an enclosed-volume-defining element formed of a cushioning fabric that is washable, soft to the touch and perspiration absorbent, said first element having top and side portions sized to tightly engage the top and side portions of said cushion and first and second end portions between said side portions, said end portions having first and second peripheral portions, said element having an opening provided by said side portions and said peripheral portions of said end portions and sized and adapted for passage of the underarm support and cushion through said opening into the volume of said element defined by said top, side, and end portions, and means disposed adjacent said opening for releasably securing said cushioning covering tightly about the entire surface of the load-bearing member, said securing means comprising:

elastic means for gathering said first and second peripheral portions beneath an underarm support, about exposed, outer edges of crutch columns, and first and second elongated flaps extending from said side portions and adapted for overlapping interengagement along the lengths of said elongated overlapping flaps beneath the underarm support, between opposed inner edges of crutch columns, to provide tight secured fitting of said covering entirely around said load bearing member, and a second cushioning covering for the second load bearing member comprising:

a second element sized and adapted to extend along the handle and cushion between the crutch columns and to extend about the circumference of the handle, and means disposed adjacent opposed edges of said second element for releasable interengagement of said edges to tightly fasten said second cushioning covering about the entire surface of the second load bearing member, said second element being formed of a cushioning fabric that is washable, soft to the touch, and perspiration absorbent.

5. The cushioning covering assembly of claim 4 wherein said cushioning fabric has nap of at least about $\frac{1}{4}$ inch.

6. The cushioning cover of claim 4 wherein said enclosed-volume-defining element contains additional padding members for the comfort of the user extending along said side portions.

* * * * *